US010892586B2

(12) United States Patent
Xie et al.

(10) Patent No.: US 10,892,586 B2
(45) Date of Patent: Jan. 12, 2021

(54) CAGE ASSEMBLY AND METHOD OF MANUFACTURING THE SAME

(71) Applicant: Tyco Electronics (Shanghai) Co. Ltd., Shanghai (CN)

(72) Inventors: Bin Xie, Shanghai (CN); Yangrong Xue, Shanghai (CN); Hongqiang Han, Shanghai (CN); See Keen Ng, Shanghai (CN); WenYu Liu, Shanghai (CN); Haibo Gan, Shanghai (CN); Xingjie Ge, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 61 days.

(21) Appl. No.: 16/109,887

(22) Filed: Aug. 23, 2018

(65) Prior Publication Data

US 2019/0067878 A1 Feb. 28, 2019

(30) Foreign Application Priority Data

Aug. 24, 2017 (CN) ..... 2017 1 0733575

(51) Int. Cl.

| | |
|---|---|
| ***H01R 13/648*** | (2006.01) |
| ***H01R 13/6582*** | (2011.01) |
| ***H01R 43/18*** | (2006.01) |
| ***H01R 13/6583*** | (2011.01) |
| *H01R 12/72* | (2011.01) |
| *H01R 13/6594* | (2011.01) |

(52) U.S. Cl.
CPC ..... *H01R 13/6582* (2013.01); *H01R 13/6583* (2013.01); *H01R 43/18* (2013.01); *H01R 12/722* (2013.01); *H01R 13/6594* (2013.01)

(58) Field of Classification Search
CPC ..... H01R 13/6582; H01R 13/6583; H01R 13/6594; H01R 12/722; H01R 43/18
USPC ..... 439/607.08, 607.09, 607.17, 607.21, 439/607.23; 385/92
See application file for complete search history.

(56) References Cited

U.S. PATENT DOCUMENTS

| | | | | |
|---|---|---|---|---|
| 7,539,018 | B2 * | 5/2009 | Murr | H05K 7/20418 165/185 |
| 7,566,245 | B1 * | 7/2009 | McColloch | G02B 6/4201 439/607.2 |
| 7,857,662 | B2 * | 12/2010 | Gillespie | H01R 13/65802 439/607.3 |
| 8,033,741 | B2 * | 10/2011 | Yoshikawa | G02B 6/4201 385/92 |
| 2014/0248794 | A1 * | 9/2014 | Khazen | G02B 6/4261 439/535 |

* cited by examiner

*Primary Examiner* — Khiem M Nguyen
(74) *Attorney, Agent, or Firm* — Barley Snyder

(57) ABSTRACT

A cage assembly comprises a cage folded from a single flat plate and an electromagnetic shielding elastic sheet assembled onto a plurality of walls of an insertion port of the cage. The electromagnetic shielding elastic sheet is configured to be pre-assembled onto a front end of the flat plate before the flat plate is folded.

19 Claims, 11 Drawing Sheets

CAGE ASSEMBLY AND METHOD OF MANUFACTURING THE SAME

CROSS-REFERENCE TO RELATED APPLICATION

This application claims the benefit of the filing date under 35 U.S.C. § 119(a)-(d) of Chinese Patent Application No. 201710733575.8, filed on Aug. 24, 2017.

FIELD OF THE INVENTION

The present invention relates to an electrical connector and, more particularly, to a cage assembly of an electrical connector.

BACKGROUND

In order to improve the electromagnetic interference resistance of a connector, it is generally necessary to mount an electromagnetic shielding elastic sheet on a cage of the connector. The electromagnetic shielding elastic sheet is generally mounted on four walls of an insertion port of the cage. Common electromagnetic shielding elastic sheets comprise an outer elastic sheet outside the cage and an inner elastic sheet inside the cage.

A molding of the cage of the connector and an assembly of the electromagnetic shielding elastic sheet cannot be completed within the same mold and must be performed separately. It is generally necessary to first form the cage of the connector in a stamping die and then to manually assemble the electromagnetic shielding elastic sheet to the cage in an assembly line.

During assembling the electromagnetic shielding elastic sheet, workers are limited by structure and space of the cage of the connector, and it is thus not easy to perform various assembly operations. For example, it is not easy to insert a tip portion of an internal elastic sheet into an insertion hole in the cage of the connector from the inside thereof. In addition, since the electromagnetic shielding elastic sheet must be assembled on the four walls of the cage of the connector, it is necessary to constantly rotate the cage of the connector during assembling. Therefore, the existing assembly efficiency of the electromagnetic shielding elastic sheet is very low, which in turn increases assembly cost of the product.

SUMMARY

A cage assembly comprises a cage folded from a single flat plate and an electromagnetic shielding elastic sheet assembled onto a plurality of walls of an insertion port of the cage. The electromagnetic shielding elastic sheet is configured to be pre-assembled onto a front end of the flat plate before the flat plate is folded.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
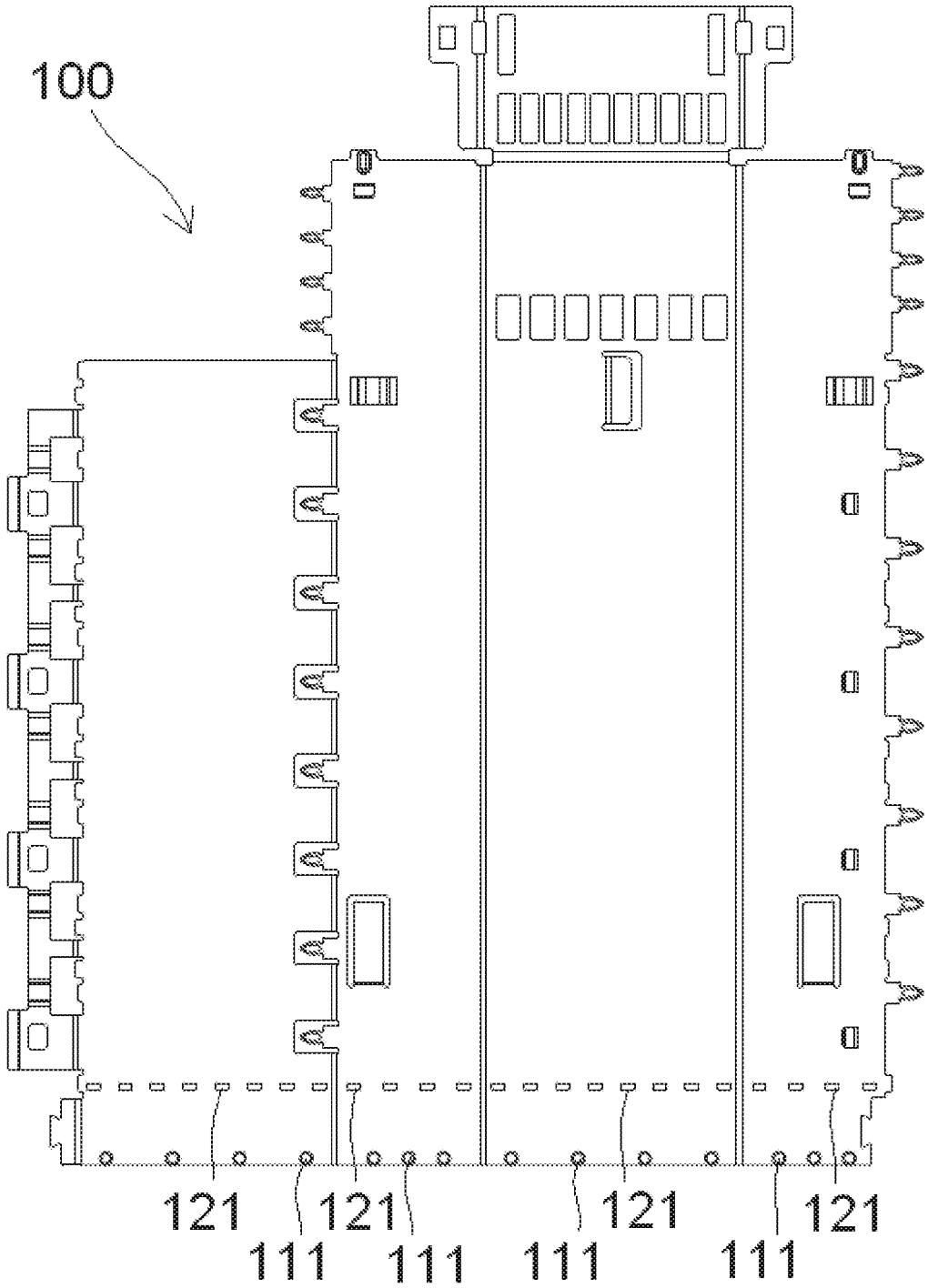
FIG. 1 is a plan view of a flat plate.

The technical solution of the disclosure will be described hereinafter in further detail with reference to the following embodiments, taken in conjunction with the accompanying drawings. In the specification, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 5A:
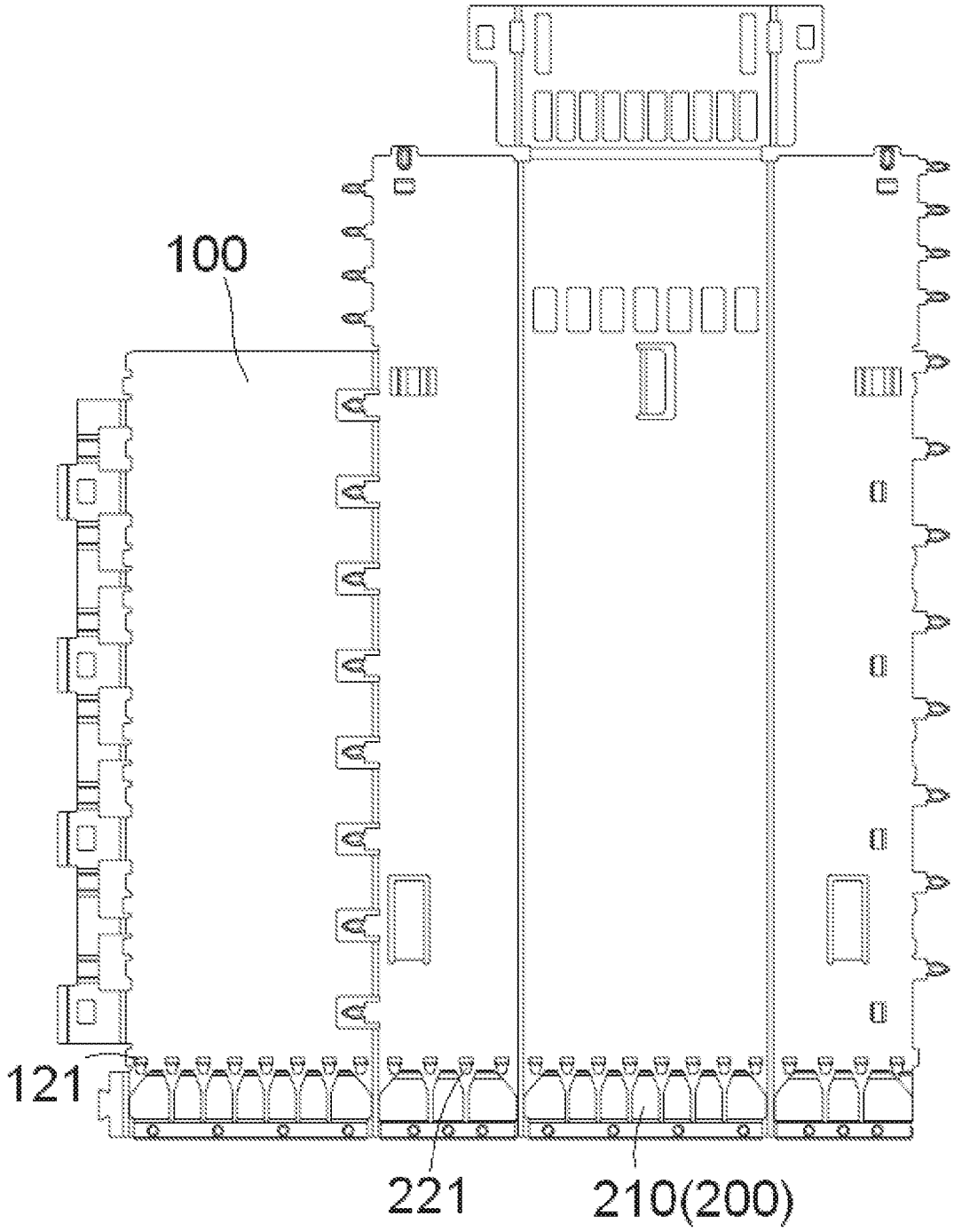
FIG. 5A is a plan view of the tip end of the second elastic sheet of the electromagnetic shielding elastic sheet bent onto an edge portion of the insertion hole.
Figure 5B:
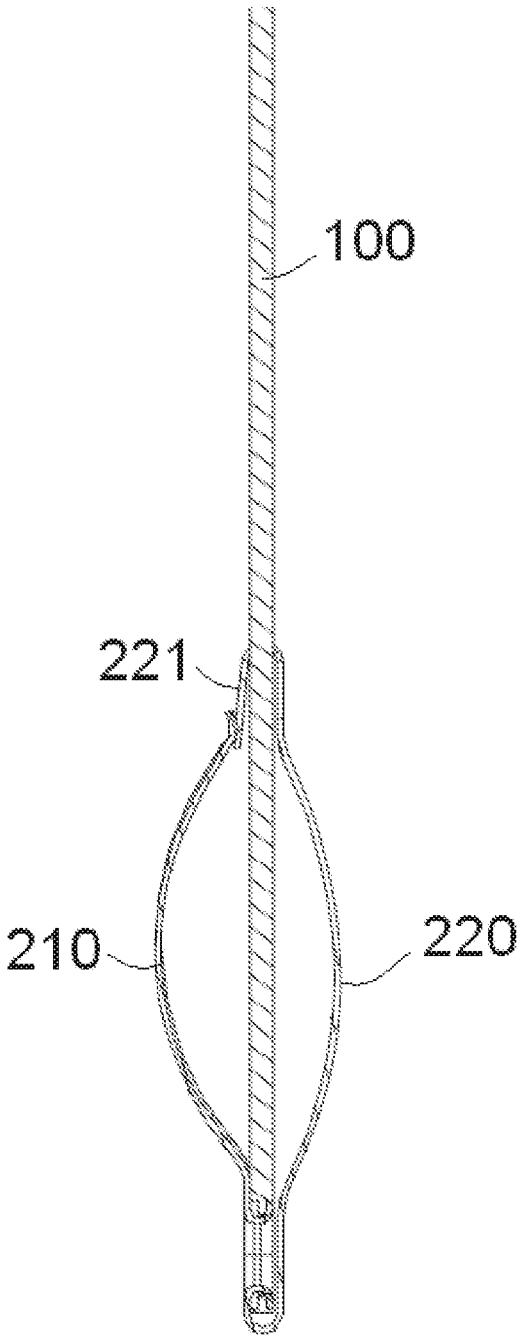
FIG. 5B is a sectional side view of the electromagnetic shielding elastic sheet and the flat plate shown in FIG. 5A.
Figure 6:
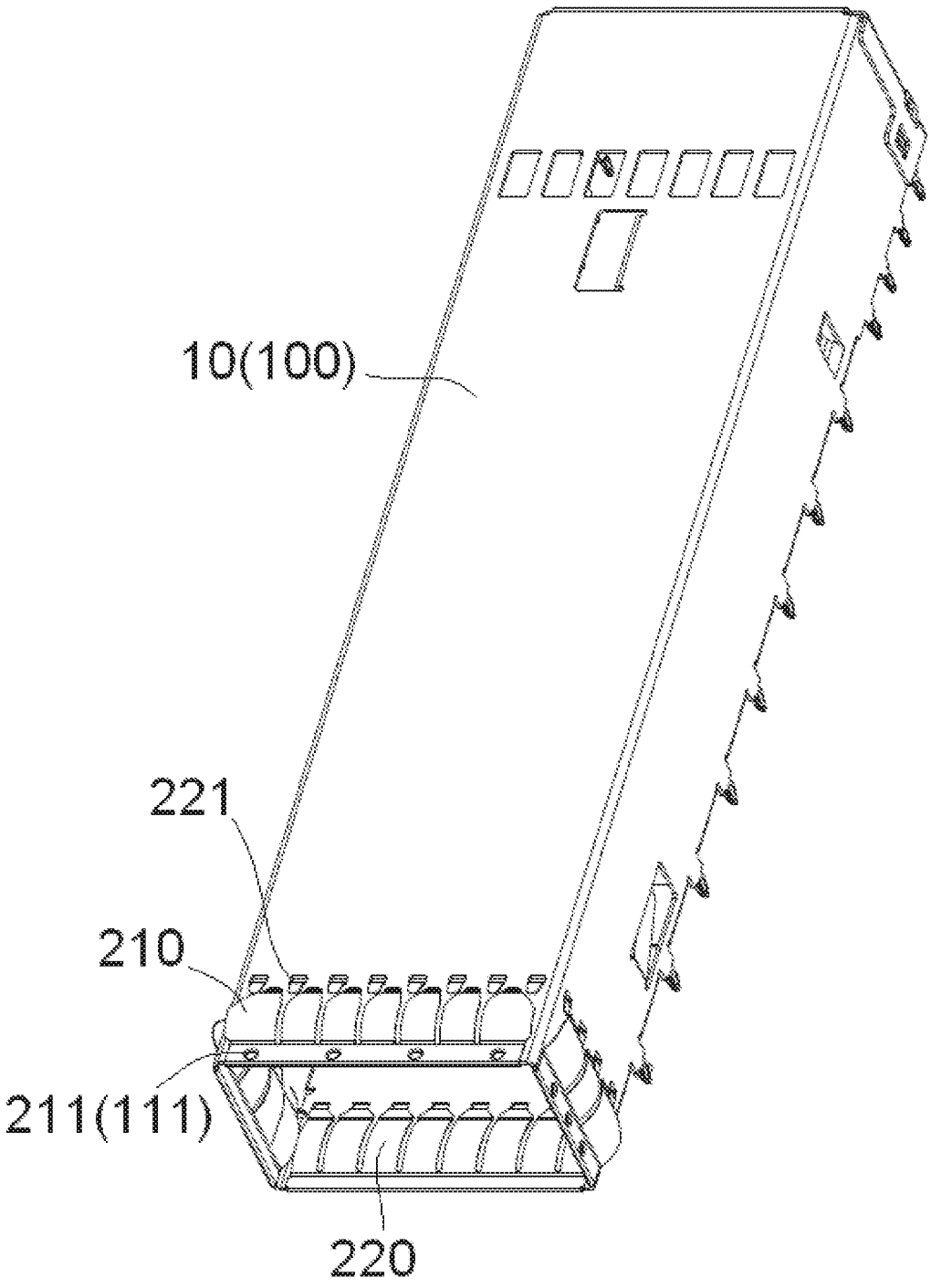
FIG. 6 is a perspective view of a cage assembly according to an embodiment including the flat plate assembled with the electromagnetic shielding elastic sheet shown in FIG. 5A after being folded into a cage.

A cage assembly according to an embodiment is shown in FIG. 6. The cage assembly comprises a cage 10 and an electromagnetic shielding elastic sheet 200 assembled onto four walls of an insertion port of the cage 10. The cage 10, as shown in FIGS. 1-5, is folded from a single flat plate 100. The electromagnetic shielding elastic sheet 200 is pre-assembled onto a front end of the flat plate 100 before the flat plate is folded. The electromagnetic shielding elastic sheet 200 includes a first elastic sheet 210 located outside the cage 10 and a second elastic sheet 220 located inside the cage 10.

Figure 2:
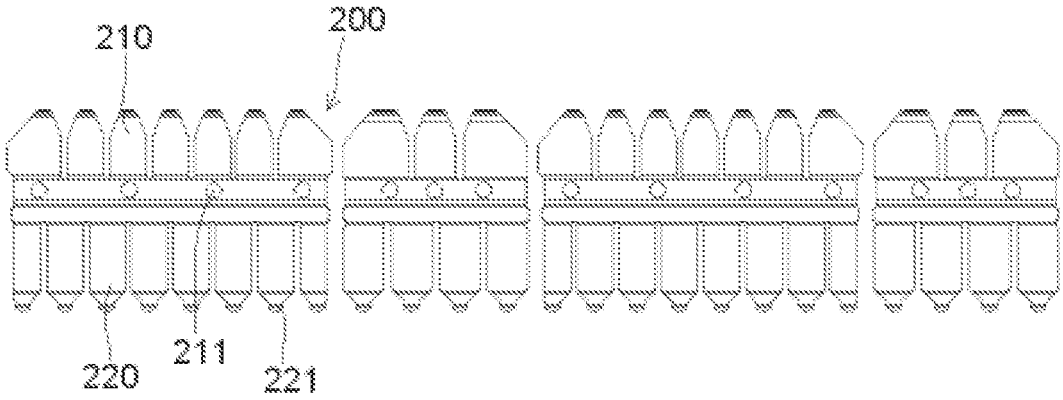
FIG. 2 is a plan view of an electromagnetic shielding elastic sheet.
Figure 3A:
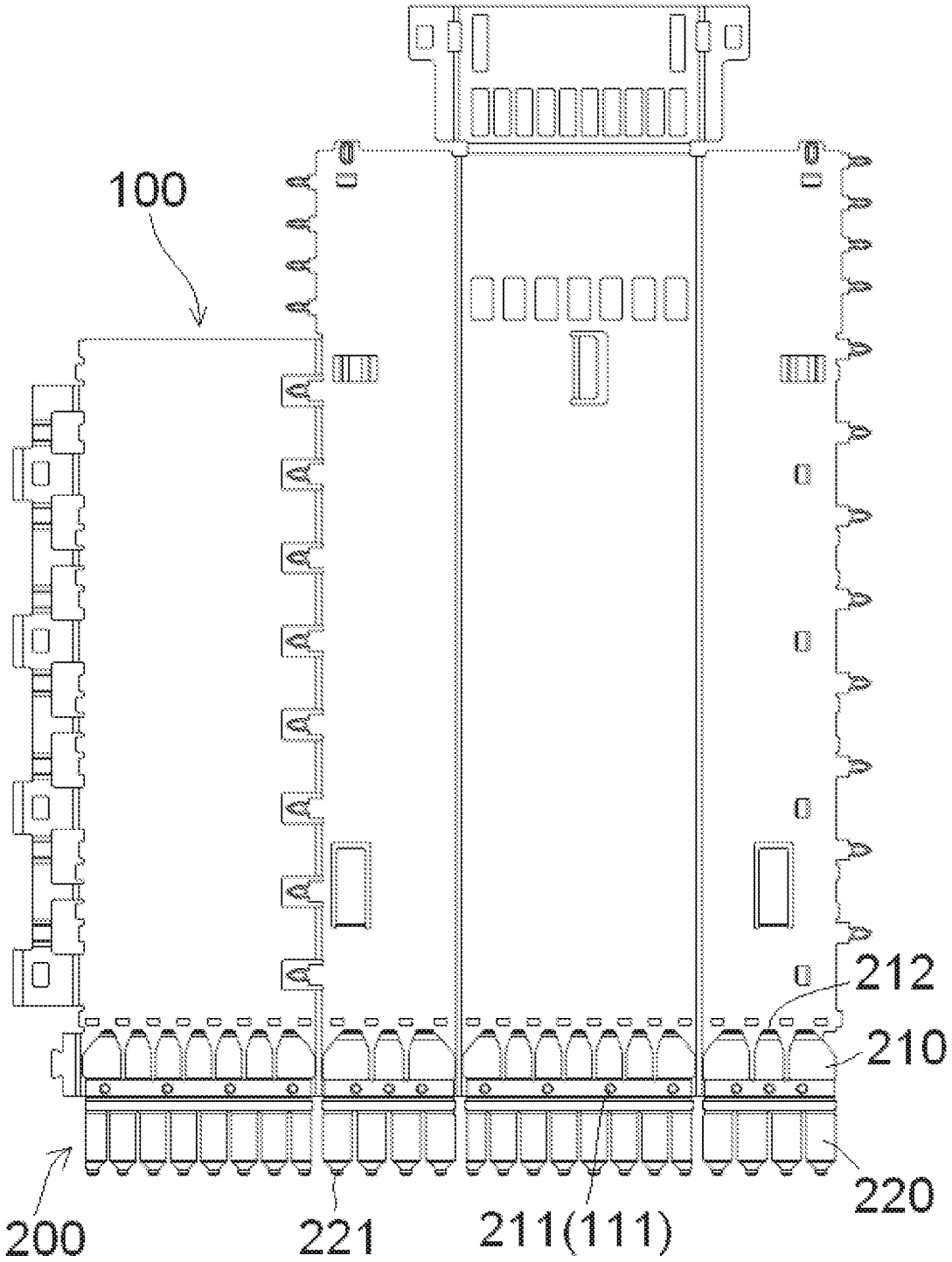
FIG. 3A is a plan view of a base portion of a first elastic sheet of the electromagnetic shielding elastic sheet riveted to one side of the flat plate.
Figure 3B:
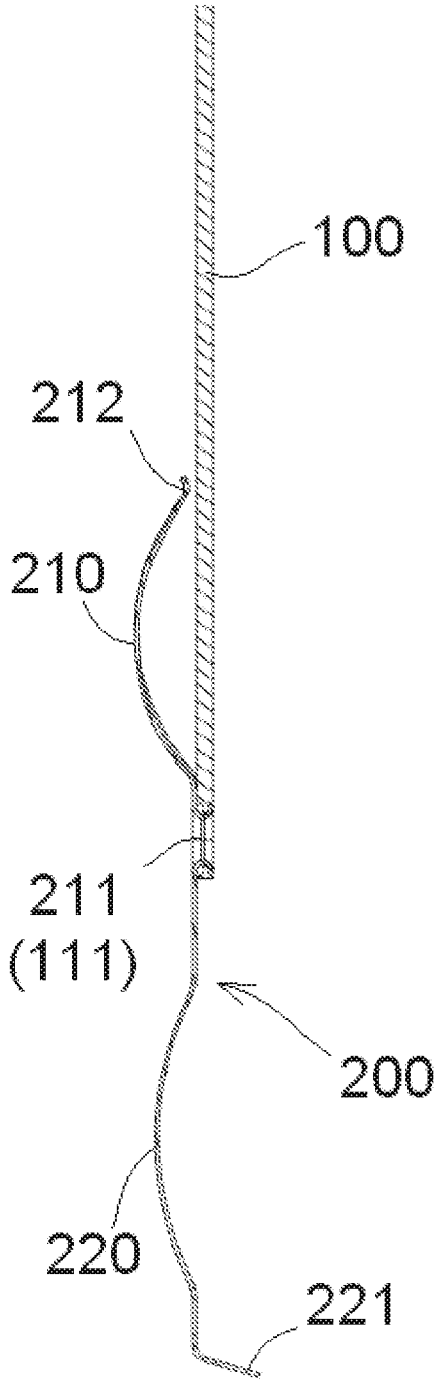
FIG. 3B is a sectional side view of the electromagnetic shielding elastic sheet and the flat plate shown in FIG. 3A.

As shown in FIGS. 3A and 3B, the first elastic sheet 210 has a base portion riveted onto the flat plate 100 and a tip portion 212 slidable freely with respect to a surface of the flat plate 100. The flat plate 100, as shown in FIGS. 1, 2, 3A, and 3B, is formed with a first hole 111 in a front end thereof. The base portion of the first elastic sheet 210 is formed with a second hole 211 having a diameter different from that of the first hole 111. An edge of one of the first hole 111 and the second hole 211, which has a smaller diameter, is rolled over an edge of the other of the first hole 111 and the second hole 211, which has a larger diameter, so that the base portion of the first elastic sheet 210 is riveted onto the flat plate 100.

Figure 7:
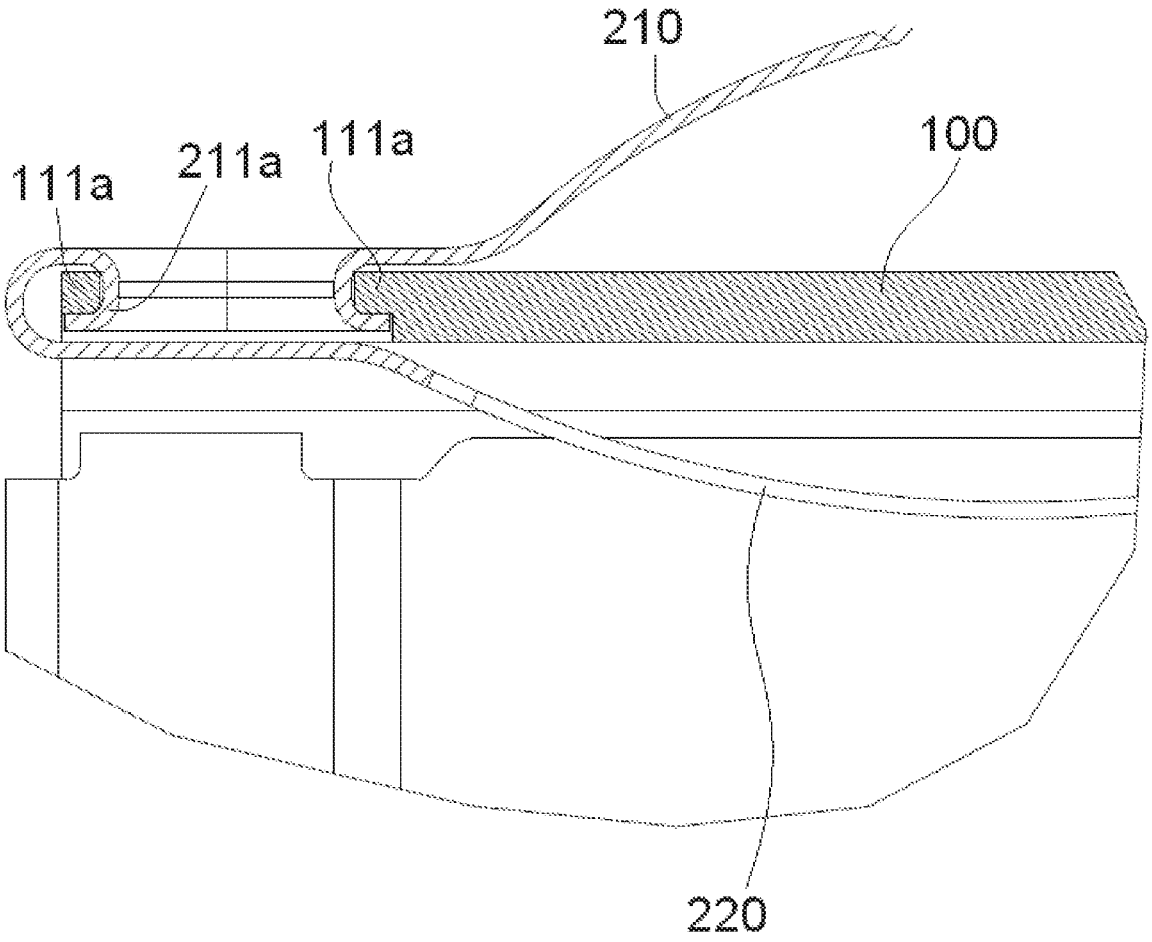
FIG. 7 is a sectional side view of an embodiment of the base portion of the first elastic sheet of the electromagnetic shielding elastic sheet riveted to the flat plate.
Figure 8:
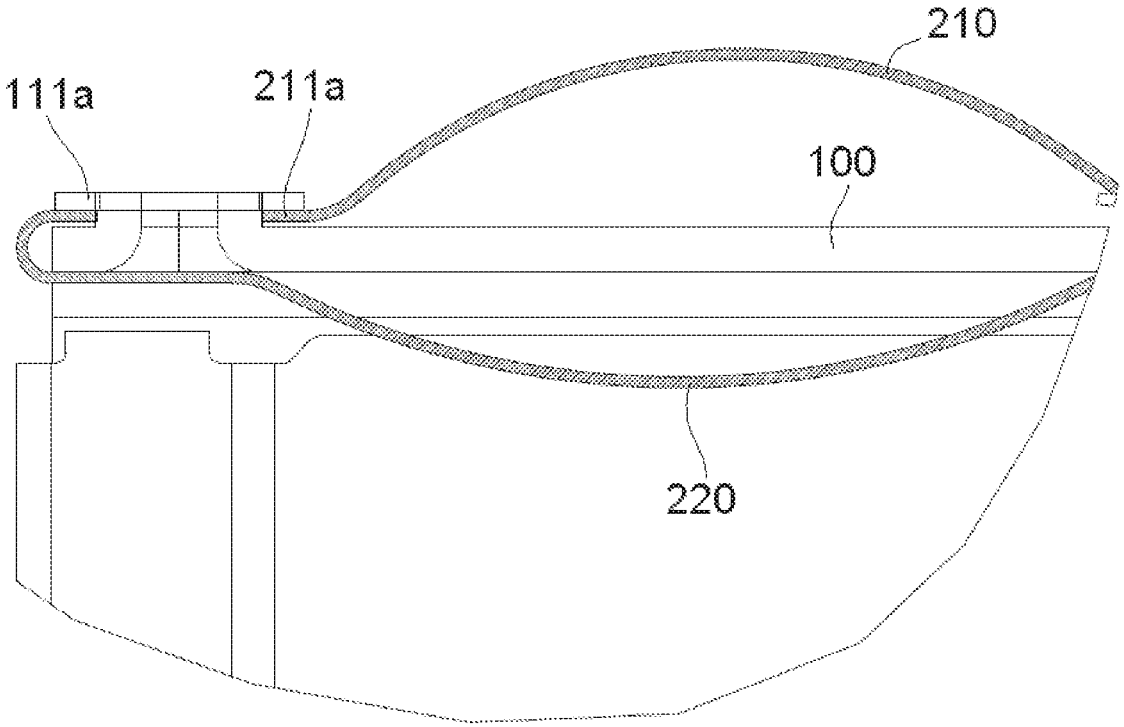
FIG. 8 is a sectional side view of another embodiment of the base portion of the first elastic sheet of the electromagnetic shielding elastic sheet riveted to the flat plate.

The base portion of the first elastic sheet 210 is shown riveted onto the flat plate 100 in FIGS. 7 and 8. In the embodiment shown in FIG. 7, the first hole 111 has an edge 111*a*, the second hole 211 has an edge 211*a*, and the diameter of the first hole 111 is smaller than that of the second hole 211. Thus, the edge 111*a* of the first hole 111 is rolled over the edge 211*a* of the second hole 211. In the embodiment shown in FIG. 8, the first hole 111 has an edge 111*a*, the second hole 211 has an edge 211*a*, and the diameter of the first hole 111 is greater than that of the second hole 211. Thus, the edge 211*a* of the second hole 211 is rolled over the edge 111*a* of the first hole 111. Although FIGS. 7 and 8 show two different riveting manners, the disclosure is not limited to the illustrated embodiments. In other embodiments, the base portion of the first elastic sheet 210 may also be fixed to the flat plate 100 by other means such as welding.

The second elastic sheet 220, as shown in FIGS. 4A, 4B, 5A, and 5B, has a base portion connected with the base portion of the first elastic sheet 210 and a tip portion 221 riveted onto the flat plate 100. The flat plate 100 is formed with an insertion hole 121 behind the first hole 111 in the front end thereof. The insertion hole 121 has an edge, and the tip portion 221 of the second elastic sheet 220 is inserted into the insertion hole 121 and is bent onto the edge of the insertion hole 121 so as to rivet the tip portion 221 of the second elastic sheet 220 onto the flat plate 100.

After the base portion of the first elastic sheet 210 is riveted onto the flat plate 100, as shown in FIGS. 4A, 4B, 5A, and 5B, the second elastic sheet 220 is bent by 180 degrees with respect to the first elastic sheet 210, such that the first elastic sheet 210 and the second elastic sheet 220 are positioned on either side of the flat plate 100, respectively. The tip portion 221 of the second elastic sheet 220 is then inserted into the insertion hole 121 and bent onto the edge of the insertion hole 121; after the second elastic sheet 220 is bent by 180 degrees.

As shown in FIG. 6, the flat plate 100 is folded to form the cage 10 after the tip portion 221 of the second elastic sheet 220 is riveted onto the flat plate 100.

A method for manufacturing the cage assembly described above will now be described in detail with reference to FIGS. 1-6.

First, the flat plate 100 is provided that is adapted to be folded to form the cage 10, as shown in FIG. 1.

Then, an electromagnetic shielding elastic sheet 200 shown in FIG. 2 is provided.

Then, the base portion of the first elastic sheet 210 is riveted onto one side of the flat plate 100, the first elastic sheet 210 having a tip portion slidable freely with respect to a surface of the one side of the flat plate 100, as shown in FIGS. 3A-3B.

Figure 4A:
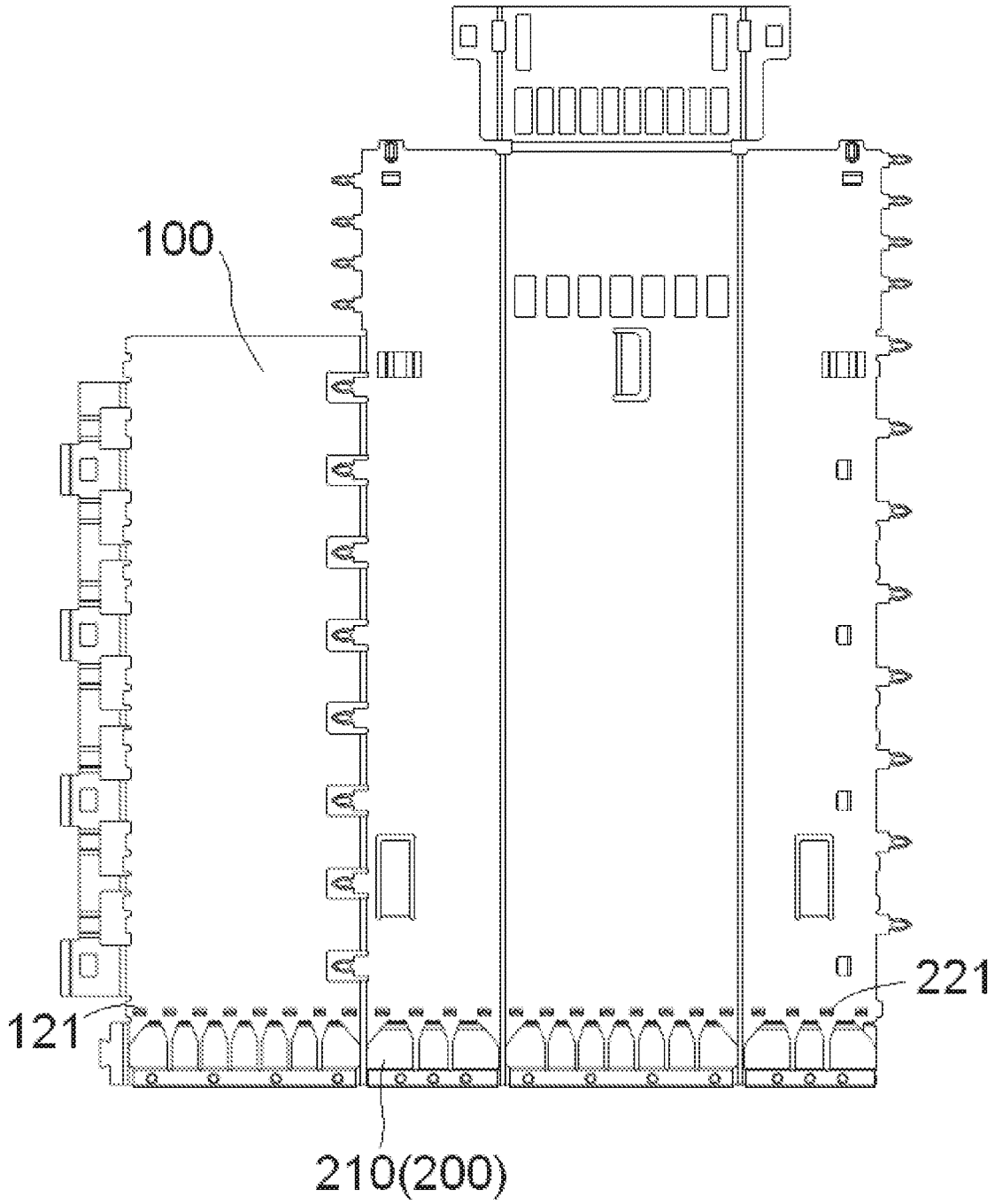
FIG. 4A is a plan view of a second elastic sheet of the electromagnetic shielding elastic sheet bent onto the other side of the flat plate and a tip end of the second elastic sheet inserted into an insertion hole in the flat plate.
Figure 4B:
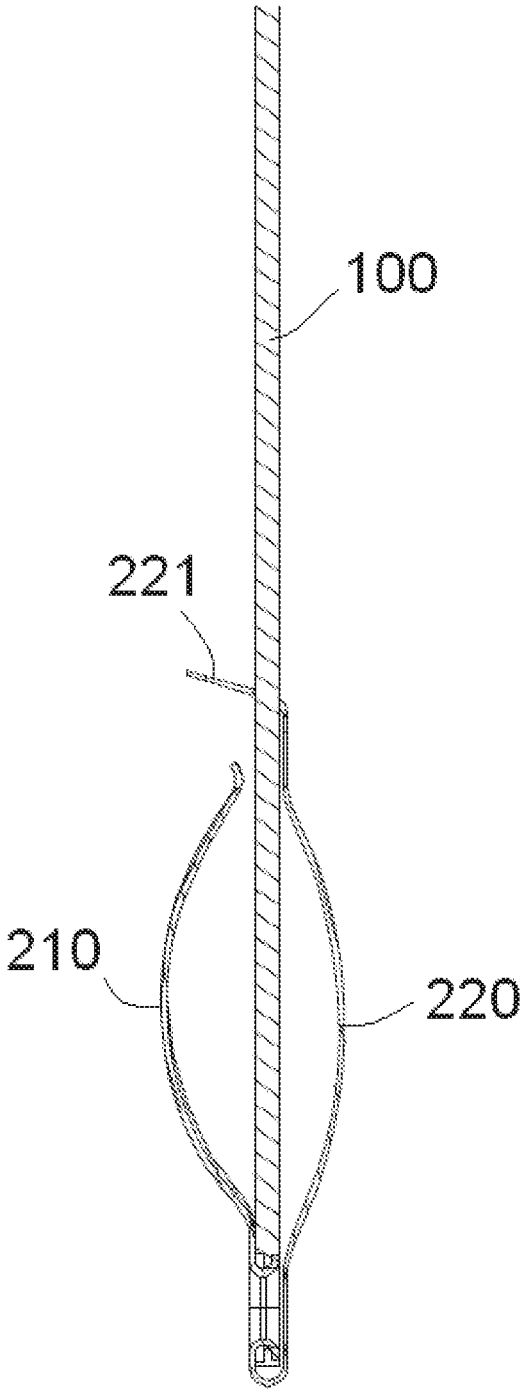
FIG. 4B is a sectional side view of the electromagnetic shielding elastic sheet and the flat plate shown in FIG. 4A.

Then, the second elastic sheet 220 is bent by 180 degrees so that the second elastic sheet 220 is located on the other side of the flat plate 100, as shown in FIGS. 4A-4B.

Then, the tip portion 221 of the second elastic sheet 220 is inserted into the insertion hole 121 in the flat plate 100, as shown in FIGS. 4A-4B.

Then, the tip portion 221 of the second elastic sheet 220 is bent onto an edge of the insertion hole 121, as shown in FIGS. 5A-5B.

Lastly, the flat plate 100 assembled with the electromagnetic shielding elastic sheet is folded into the cage 10, as shown in FIG. 6. The step of assembling the electromagnetic shielding elastic sheet 200 onto the front end of the flat plate 100 and the step of folding the flat plate 100 to form the cage 10 are performed in the same mold. Because it is very easy to assemble the electromagnetic shielding elastic sheet 200 onto the flat plate 100, the cage assembly of the disclosure greatly improves the assembly efficiency of the electromagnetic shielding elastic sheet 200, which in turn reduces assembly cost.

What is claimed is:

1. A cage assembly, comprising:

a cage folded from a single flat plate; and an electromagnetic shielding elastic sheet assembled onto a plurality of walls of an insertion port of the cage, the electromagnetic shielding elastic sheet is configured to be pre-assembled onto a front end of the flat plate before the flat plate is folded and includes:

a first elastic sheet located outside the cage and having a base portion attached to the flat plate and a tip portion slidable freely with respect to a surface of the flat plate; and a second elastic sheet located inside the cage and having a base portion connected with the base portion of the first elastic sheet and a tip portion, wherein the tip portion of the second elastic sheet is inserted into an insertion hole of the flat plate and is bent onto an edge of the insertion hole so as to rivet the tip portion of the second elastic sheet onto the flat plate.

2. The cage assembly of claim 1, wherein the base portion of the first elastic sheet is riveted onto the flat plate.

3. The cage assembly of claim 2, wherein the flat plate has a first hole in a front end of the flat plate and the base portion of the first elastic sheet has a second hole having a diameter different from a diameter of the first hole.

4. The cage assembly of claim 3, wherein an edge of the first hole or an edge of the second hole having a smaller diameter is rolled over the edge of the first hole or the edge of the second hole having a larger diameter, so that the base portion of the first elastic sheet is riveted onto the flat plate.

5. The cage assembly of claim 4, wherein the diameter of the first hole is smaller than the diameter of the second hole and the edge of the first hole is rolled over the edge of the second hole.

6. The cage assembly of claim 4, wherein the diameter of the first hole is greater than the diameter of the second hole and the edge of the second hole is rolled over the edge of the first hole.

7. The cage assembly of claim 5, wherein the insertion hole is located behind the first hole in the front end of the flat plate.

8. The cage assembly of claim 7, wherein, after the base portion of the first elastic sheet is riveted onto the flat plate, the second elastic sheet is bent by 180 degrees with respect to the first elastic sheet such that the first elastic sheet and the second elastic sheet are positioned on a pair of opposite sides of the flat plate.

9. The cage assembly of claim 8, wherein the tip portion of the second elastic sheet is inserted into the insertion hole and is bent onto the edge of the insertion hole after the second elastic sheet is bent by 180 degrees.

10. The cage assembly of claim 9, wherein the flat plate is folded to form the cage after the tip portion of the second elastic sheet is riveted onto the flat plate.

11. A cage assembly, comprising:

a cage folded from a single flat plate; and an electromagnetic shielding elastic sheet assembled onto a plurality of walls of an insertion port of the cage, the electromagnetic shielding elastic sheet is configured to be pre-assembled onto a front end of the flat plate before the flat plate is folded, the electromagnetic shielding elastic sheet including an inner elastic sheet located inside the cage having a base portion for attaching to the flat plate and a tip portion, wherein the tip portion of the inner elastic sheet is fastened to the flat plate.

12. The cage assembly of claim 11, wherein tip portion is riveted onto the flat plate.

13. The cage assembly of claim 11, wherein tip portion extends through an insertion hole of the flat plate from inside the cage for fastening the tip portion to the flat plate.

14. The cage assembly of claim 13, wherein the tip portion of the inner elastic sheet inserted into the insertion hole of the flat plate and is bent onto an edge of the insertion hole for securing the tip portion of the inner elastic sheet onto the flat plate.

15. The cage assembly of claim 11, wherein the electromagnetic shielding elastic sheet further includes an outer elastic sheet located outside the cage, the outer elastic sheet having a base portion connected to the base portion of the inner elastic sheet.

16. The cage assembly of claim 15, wherein the base portion of the outer elastic sheet is attached to the flat plate.

17. The cage assembly of claim 16, wherein the outer elastic sheet is attached to the flat plate via at least one rivet defined through the base portion of the outer elastic sheet.

18. The cage assembly of claim 17, wherein the at least one rivet is formed only through the outer elastic sheet and the flat plate.

19. The cage assembly of claim 15, wherein the outer elastic sheet comprises and a tip portion slidable freely with respect to a surface of the flat plate.

* * * * *